US007622724B2

(12) United States Patent
Chang et al.

(10) Patent No.: US 7,622,724 B2
(45) Date of Patent: Nov. 24, 2009

(54) HIGH VOLTAGE INSULATOR FOR PREVENTING INSTABILITY IN AN ION IMPLANTER DUE TO TRIPLE-JUNCTION BREAKDOWN

(75) Inventors: Shengwu Chang, Hamilton, MA (US); Frank Sinclair, Quincy, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 365 days.

(21) Appl. No.: 11/767,657

(22) Filed: Jun. 25, 2007

(65) Prior Publication Data

US 2008/0315114 A1 Dec. 25, 2008

(51) Int. Cl.
*G21K 5/00* (2006.01)

(52) U.S. Cl. ..... 250/492.21; 250/492.1; 250/492.2; 250/492.22; 250/492.23

(58) Field of Classification Search ..... 250/492.1, 250/492.2, 492.21, 492.22, 492.23
See application file for complete search history.

(56) References Cited

U.S. PATENT DOCUMENTS 7,045,798 B2 * 5/2006 Elsheref et al. ..... 250/492.2
2004/0256578 A1 12/2004 Mitchell et al.
2005/0151089 A1 7/2005 Bong et al.

OTHER PUBLICATIONS

Pillai et al., "Influence of metal-insulator junction on surface flash-over in vacuum," Jun. 1987, pp. 4992-4999, J. Appl. Phys. 61(11), 1987 American Institute of Physics.

* cited by examiner

*Primary Examiner*—Nikita Wells
*Assistant Examiner*—Hanway Chang

(57) ABSTRACT

A high voltage insulator for preventing instability in an ion implanter due to triple junction breakdown is described. In one embodiment, there is an apparatus for preventing triple junction instability in an ion implanter. In this embodiment, there is a first metal electrode and a second metal electrode. An insulator is disposed between the first metal electrode and the second metal electrode. The insulator has at least one surface between the first metal electrode and the second metal electrode that is exposed to a vacuum that transports an ion beam generated by the ion implanter. A first conductive layer is located between the first metal electrode and the insulator. The first conductive layer prevents triple junction breakdown from occurring at an interface of the first electrode, insulator and vacuum. A second conductive layer is located between the second metal electrode and the insulator opposite the first conductive layer. The second conductive layer prevents triple junction breakdown from occurring at an interface of the second electrode, insulator and vacuum.

21 Claims, 4 Drawing Sheets

PRIOR ART

PRIOR ART

HIGH VOLTAGE INSULATOR FOR PREVENTING INSTABILITY IN AN ION IMPLANTER DUE TO TRIPLE-JUNCTION BREAKDOWN

BACKGROUND

This disclosure relates generally to ion implanters, and more specifically to a high voltage insulator that prevents instability in an ion implanter due to triple junction breakdown.

A high voltage insulator is typically used in an ion implanter in locations along the beamline where there is a need for high voltage. For example, high voltage is necessary to extract an ion beam from an ion source. In particular, a high voltage insulator is used with an extraction system that receives the ion beam from the ion source and accelerates positively charged ions from within the beam as it leaves the source. Other locations where a high voltage insulator can be used in the beamline include an electrostatic lens that focuses the ion beam and an acceleration or deceleration stage that accelerates or decelerates the ion beam to a desired energy, respectively.

Current high voltage insulator designs that are in use with a typical ion implanter are subject to triple junction breakdowns that lead to instability (e.g., high voltage instability, ion beam instability) and eventually failure of the implanter. A triple junction region in a high voltage insulator is the junction or region where three volumes having different electrical characteristics come together and thus the local electric field at the triple junction region is intensified due to the step change of the electrical characteristics at the triple junction region. The three volumes typically include a dielectric (e.g., insulator) that holds off high voltage, metal electrodes (e.g., metallic conductor), and a vacuum in the interior of the beamline. The dielectric and the metallic conductor together form the vacuum vessel to transport the ion beam and protect it from atmospheric pressure. An O-ring is sandwiched between the dielectric and the metallic conductor to provide a vacuum seal from atmospheric pressure. In addition, the O-ring allows the metallic conductor to be disassembled from the dielectric during the maintenance of the high voltage insulator. A vacuum seal interface gap is produced between the dielectric and the metallic conductor. The vacuum seal interface gap is a narrow or microscopic space containing many voids. The vacuum seal interface gap is located at exactly the same place where a triple junction region is located.

During operation of the high voltage insulator, these voids formed in the vacuum seal interface gap or triple junction region not only have intensified local electric fields but also have poor vacuum pressure that promote electric discharge which makes the vacuum pressure even worse, triggering a secondary ionization. Eventually the secondary ionization will trigger a breakdown in a triple junction region that propagates along an inner surface of the dielectric until it reaches the opposite electrode and shorts out the power supply, resulting in ion implanter failure.

Therefore, it is desirable to develop a high voltage insulator that can prevent triple junction breakdown that causes instability in an ion implanter.

SUMMARY

In a first embodiment, there is an apparatus for preventing triple junction breakdown. In this embodiment, the apparatus comprises a first metal electrode and a second metal electrode. An insulator is disposed between the first metal electrode and the second metal electrode. The insulator has at least one surface between the first metal electrode and the second metal electrode that is exposed to a vacuum. A first conductive layer is located between the first metal electrode and the insulator. The first conductive layer prevents triple junction breakdown from occurring at an interface of the first electrode, insulator and vacuum. A second conductive layer is located between the second metal electrode and the insulator opposite the first conductive layer. The second conductive layer prevents triple junction breakdown from occurring at an interface of the second electrode, insulator and vacuum.

In a second embodiment, there is an apparatus for preventing triple junction instability in an ion implanter. In this embodiment, the apparatus comprises a first metal electrode and a second metal electrode. An insulator is disposed between the first metal electrode and the second metal electrode. The insulator has at least one surface between the first metal electrode and the second metal electrode that is exposed to a vacuum that transports an ion beam generated by the ion implanter. A first conductive layer is located between the first metal electrode and the insulator. The first conductive layer prevents triple junction breakdown from occurring at an interface of the first electrode, insulator and vacuum. A second conductive layer is located between the second metal electrode and the insulator opposite the first conductive layer. The second conductive layer prevents triple junction breakdown from occurring at an interface of the second electrode, insulator and vacuum.

In a third embodiment, there is a method for preventing triple junction instability in an ion implanter. In this embodiment, the method comprises providing a first metal electrode; providing a second metal electrode; disposing an insulator between the first metal electrode and the second metal electrode, wherein the insulator has at least one surface between the first metal electrode and the second metal electrode that is exposed to a vacuum that transports an ion beam generated by the ion implanter; providing a first conductive layer located between the first metal electrode and the insulator, wherein the first conductive layer prevents triple junction breakdown from occurring at an interface of the first electrode, insulator and vacuum; and providing a second conductive layer located between the second metal electrode and the insulator opposite the first conductive layer, wherein the second conductive layer prevents triple junction breakdown from occurring at an interface of the second electrode, insulator and vacuum.

DETAILED DESCRIPTION

Embodiments of this disclosure are directed to a high voltage insulator design that prevents triple junction instability in an ion implanter. In one embodiment, conductive layers or plates are placed between a dielectric (e.g., an insulator) and the metal electrodes (e.g., metallic conductor). With this design, one end of the insulator is joined to a first conductive layer to form a first triple junction using a joining technique that minimizes formation of the voids in the first triple junction region, while the first conductive layer is attached to the first metal electrode. A first O-ring is sandwiched between the first conductive layer and the first metal electrode to seal the vacuum from the atmospheric pressure. This forms a first vacuum seal interface gap at the space between the first conductive layer and the first metal electrode. Another end of the insulator is joined to a second conductive layer to form a second triple junction using a joining technique that minimizes formation of the voids in the second triple junction region, while the second conductive layer is attached to the second metal electrode. A second O-ring is sandwiched between the second conductive layer and the second metal electrode to seal the vacuum from the atmospheric pressure. This forms a second vacuum seal interface gap at the space between the second conductive layer and the second metal electrode. Because the vacuum seal interface gaps now are separated from the triple junction regions, gases that used to be trapped in the voids formed at the triple junction regions, are trapped in the spaces between the first conductive layer and the first metal electrode or between the second conductive layer and the second metal electrode having the same electric potential, and do not have an opportunity to initiate a breakdown that leads to failure of the ion implanter.

Figure 1:
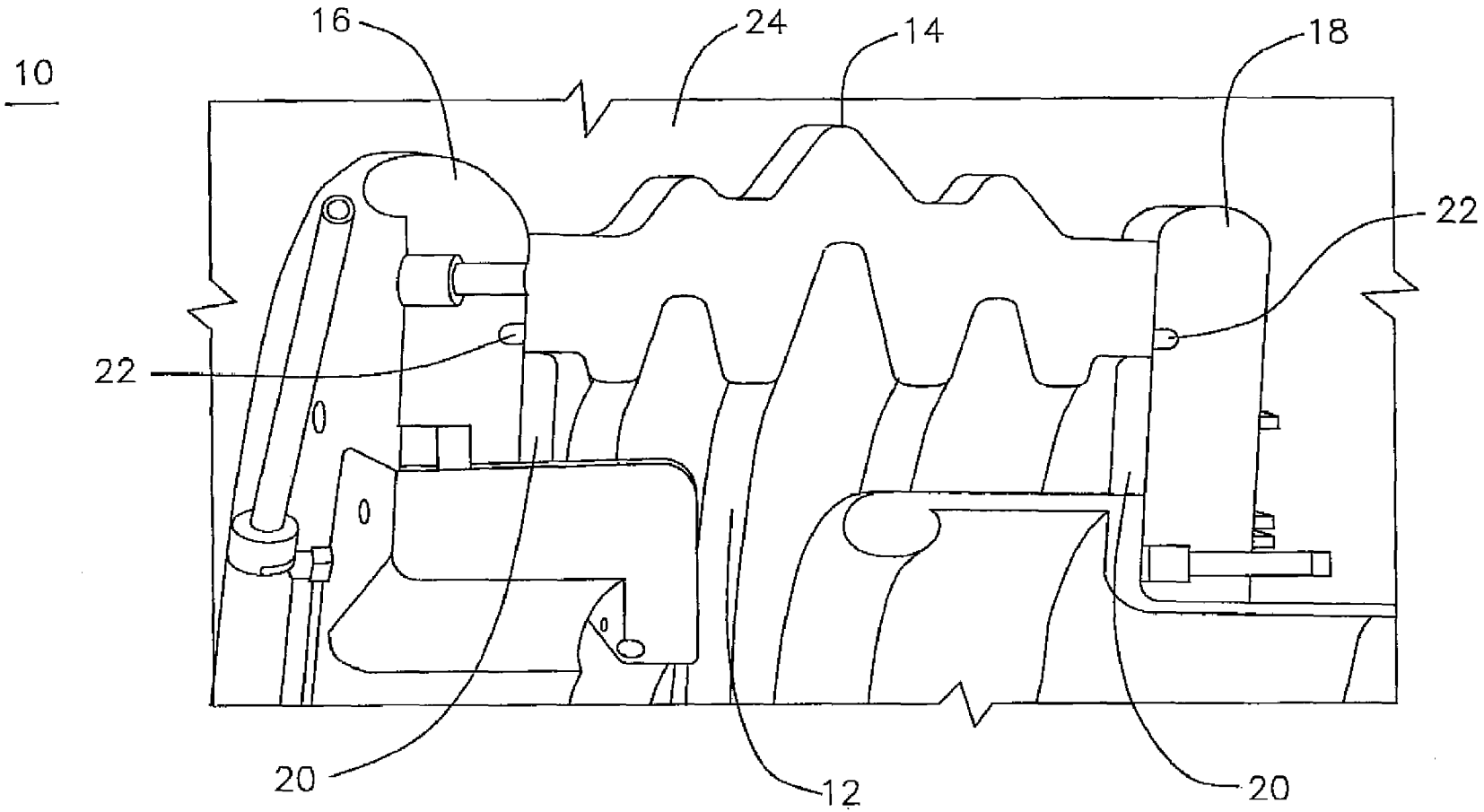
FIG. 1 shows a front view of a cross-section of a high-voltage insulator according to the prior art.

FIG. 1 shows a front view of a cross-section of a high-voltage insulator 10 according to the prior art. The high-voltage insulator 10 shown in FIG. 1 is for use in an ion implanter. In particular, the high voltage insulator 10 is used in an extraction system that extracts an ion beam from an ion source. Although the description that follows for the high voltage insulator 10 shown in FIG. 1 and the insulator design that relates to this disclosure (see FIGS. 3 and 4) is directed to an extraction system in an ion implanter, the scope of this disclosure is applicable to other components within the beamline of an ion implanter that need a high voltage. As mentioned above, other locations where a high voltage insulator can be used include an electrostatic lens, acceleration stage or deceleration stage.

Referring back to FIG. 1, the high voltage insulator 10 includes a vacuum 12 formed within an insulator 14, anode electrode 16 and a cathode electrode 18. In one embodiment, the insulator 14 is a dielectric while the anode electrode 16 and the cathode electrode 18 are metal electrodes. As shown in FIG. 1, the insulator 14 separates the anode electrode 16 from the cathode electrode 18 in order to hold a high voltage that is necessary to extract ions from an ion source. Stress relief features 20, which are metal components such as aluminum, reduce electrical stress at triple junction regions, which are interfaces where the vacuum 12, insulator 14, anode electrode 16 or cathode electrode 18 meet. In particular, the stress relief features 20 function to reduce the electric field that intensifies at the triple junction regions. O-rings 22 are positioned between the anode electrode 16 and one end of the insulator 14 and between the cathode electrode 18 and another end of the insulator to provide vacuum seals from atmospheric pressure 24. The O-rings 22 are typically accommodated in a groove that allows assembly of the insulator 14 to the anode electrode 16 and cathode electrode 18 to be clamped tight by fasteners (not shown) while producing an appropriate compression for a vacuum seal.

The high voltage insulator 10 of FIG. 1 operates by maintaining a high voltage across the insulator 14, anode electrode 16 and cathode electrode 18 in order to extract ions from an ion source in the form of an ion beam. The ion beam moves through the vacuum 12 keeping its polarity because atmospheric pressure from the atmosphere 24 is sealed off.

Although the high voltage insulator 10 of FIG. 1 utilizes stress relief features 20 to reduce the electric field at the triple junction regions, these features are not very effective and eventually breakdown will occur at the triple junction regions and lead to failure of the ion implanter. The root cause for the breakdown at the triple junction regions in the high voltage insulator 10 is due to a first vacuum seal interface gap formed between the insulator 14 and the anode electrode 16 at one end and a second vacuum seal interface gap formed between the insulator 14 and the cathode electrode 18 at the other end, which are both located at the exactly same places where the triple junction regions are located. As mentioned above, the vacuum seal interface gap is a narrow or microscopic space that contains many voids, which are also in the triple junction regions. Because of the extreme aspect ratio of the vacuum seal interface gaps, the volume associated with the voids formed in each vacuum seal interface gap are poorly evacuated. From the perspective of the overall vacuum system used in the ion implanter, the volume associated with these voids are so small that trapped gas that slowly leaks out is essentially a negligible gas load that does not significantly increase pressure.

From the perspective of the high voltage triple junctions, the inventors have ascertained that this situation exposes a critical weakness in the conventional design of the high voltage insulator 10. In particular, if high voltage operation is initiated as soon as possible after vacuum conditions have been established, then the gas in this trapped volume will still be slowly leaking out, but creating very local high pressures in exactly the worst place having the local electric field intensified (i.e., triple junction regions). Such local pressures may reach the Paschen minimum where the mean free path of charged particles is just sufficient to allow them to gain enough energy to initiate a secondary ionization. Consequently, breakdown occurs across the channel formed in the triple junction regions between the insulator 14 and the anode electrode 16 or cathode electrode 18, despite the presence of the relief features 20. Furthermore, the local vacuum pressure in the triple junction regions rises due to the outgassing associated with the breakdown, which in turn fuels the secondary ionization and the breakdown.

The result of this positive feedback loop is that this initial breakdown causes the insulator 14 to develop a carbonized layer that is a resistive conductor. This initiates "tracking" because the tip of such a carbonized region will cause an electric field concentration at the triple junction regions, resulting in the breakdown propagating along the inner surface of the insulator 14 until it reaches the opposite electrode (i.e., anode electrode 16 and cathode electrode 18) and shorts out the power supply leading to failure of the ion implanter.

Figure 2:
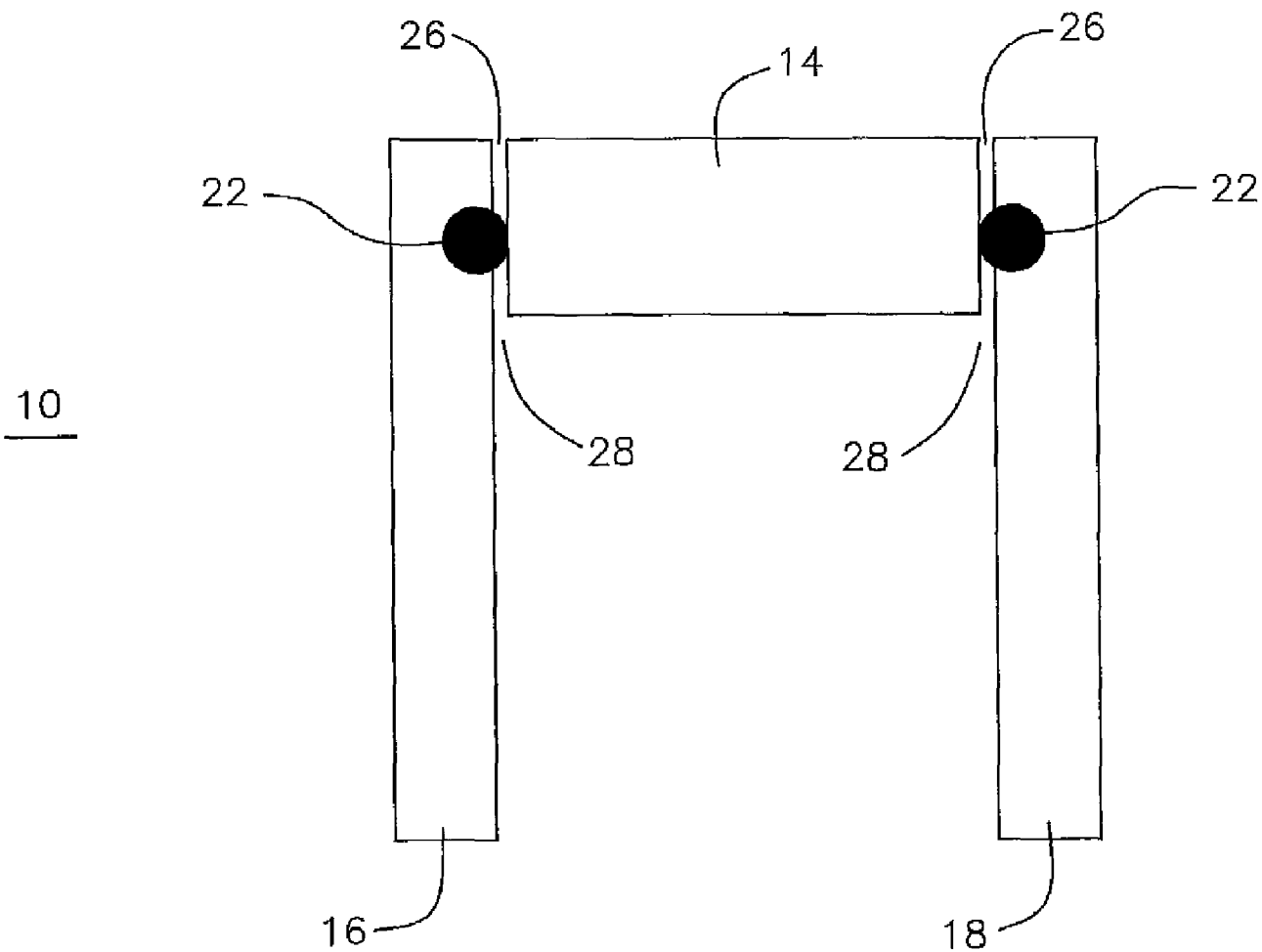
FIG. 2 shows a more detailed schematic illustrating the triple junction regions of the high-voltage insulator of FIG. 1.

FIG. 2 shows a more detailed schematic illustrating the triple junction region of the high-voltage insulator 10 shown in FIG. 1. As shown in FIG. 2, a vacuum seal interface gap 26 is formed at each triple junction region 28. During a high voltage operation, the local electric field is intensified in the vacuum seal interface gaps 26 due to the step change of the electrical characteristic in the triple junction regions 28 that cause an electric field concentration in the gaps 26. This intensified electric field in each localized vacuum seal interface gap 26 detaches the charged particles (absorbed gases, deposited contaminants) from one surface of the vacuum gap 26, which impinge with sufficient energy on the other surface of the gap to trigger a secondary emission of charged particles leading to positive feedback.

As mentioned above, gas trapped in the space associated with the vacuum seal interface gaps 26 will slowly leak out and create a very high pressure in this volume. Such local pressures may reach the Paschen minimum where the mean free path of the charged particles is just sufficient to allow them to gain enough energy to initiate a secondary ionization in the localized vacuum seal interface gaps 26. Consequently, breakdown occurs across the vacuum seal interface gaps 26 and the local vacuum pressure in the gaps rises due to the outgassing associated with the breakdown, which in turn fuels the secondary ionization and the breakdown. This initial breakdown results in the consequential breakdown that propagates along the inner surface of the insulator 14 until it reaches the opposite electrode (i.e., anode electrode 16 or cathode electrode 18).

Figure 3:
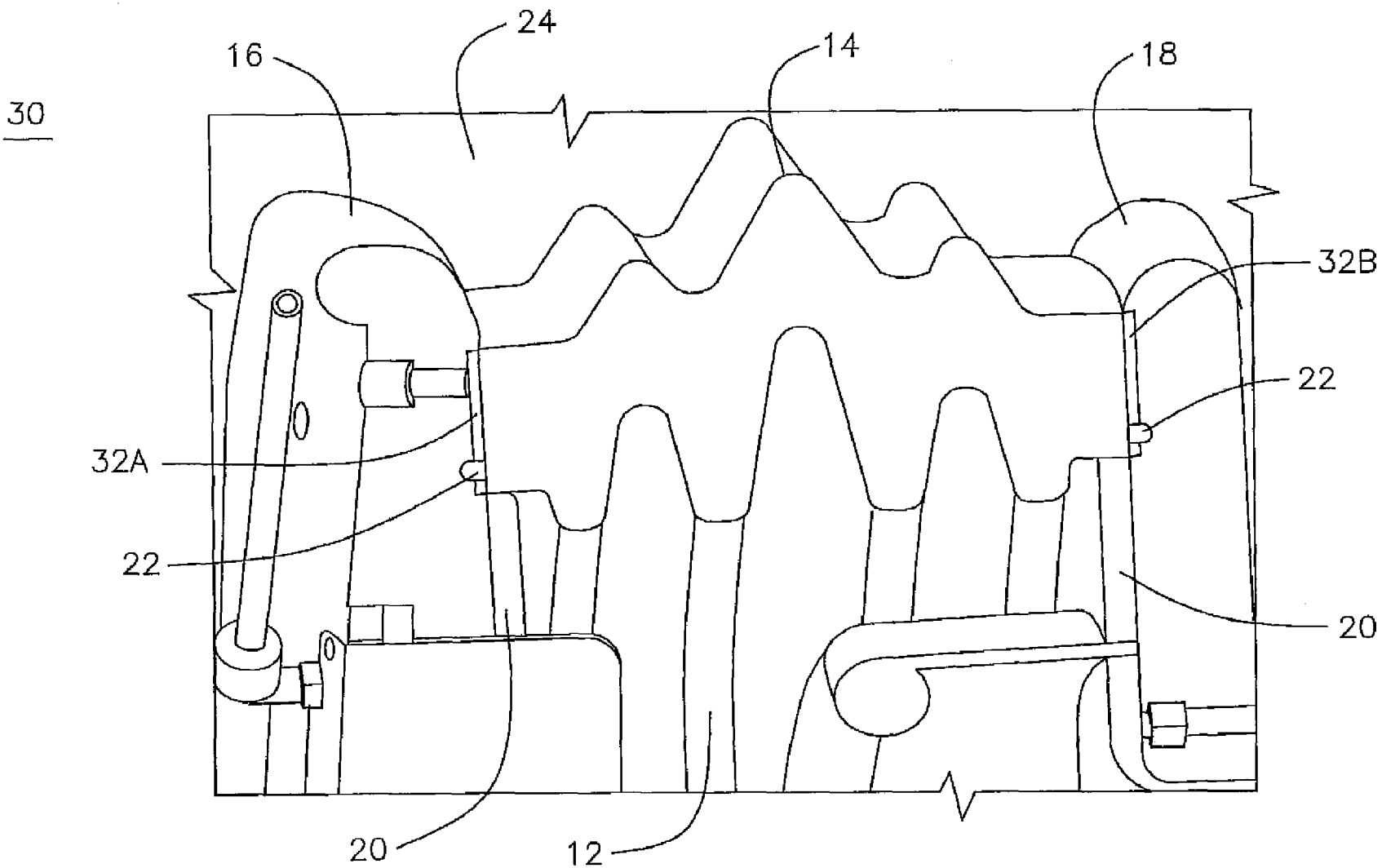
FIG. 3 shows a front view of a cross-section of a high-voltage insulator according to one embodiment of this disclosure.

The inventors to this disclosure have discovered that effects from triple junction breakdown can be avoided by separating the triple junction regions 28 from the vacuum seal interface gaps 26. FIG. 3 shows a schematic of a high voltage insulator 30 according to one embodiment of this disclosure that separates the triple junction regions from the vacuum seal interface gaps. As shown in FIG. 3, the high voltage insulator 30 includes a first conductive layer 32A between one end of the insulator 14 and the anode electrode 16 and a second conductive layer 32B between the opposite end of the insulator and the cathode electrode 18.

With this configuration, one end of the insulator 14 is joined to the conductive layer 32A using a joining technique to form the first triple junction at the joint between the insulator 14 and the conductive layer 32A. The joining technique minimizes formation of the voids in the first triple junction region while the conductive layer 32A is attached to the anode electrode 16. An O-ring 22 is sandwiched between the conductive layer 32A and the anode electrode 16 to seal the vacuum from the atmospheric pressure. This forms a first vacuum seal interface gap at the space between the conductive layer 32A and the anode electrode 16. Another end of the insulator 14 is joined to the conductive layer 32B using a joining technique to form a second triple junction at the joint between the insulator 14 and the conductive layer 32B. The joining technique minimizes formation of the voids in the second triple junction region while the conductive layer 32B is attached to the cathode electrode 18. Another O-ring 22 is sandwiched between the conductive layer 32B and the cathode electrode 18 to seal the vacuum from the atmospheric pressure. This forms a second vacuum seal interface gap at the space between the conductive layer 32B and the cathode electrode 18.

Figure 4:
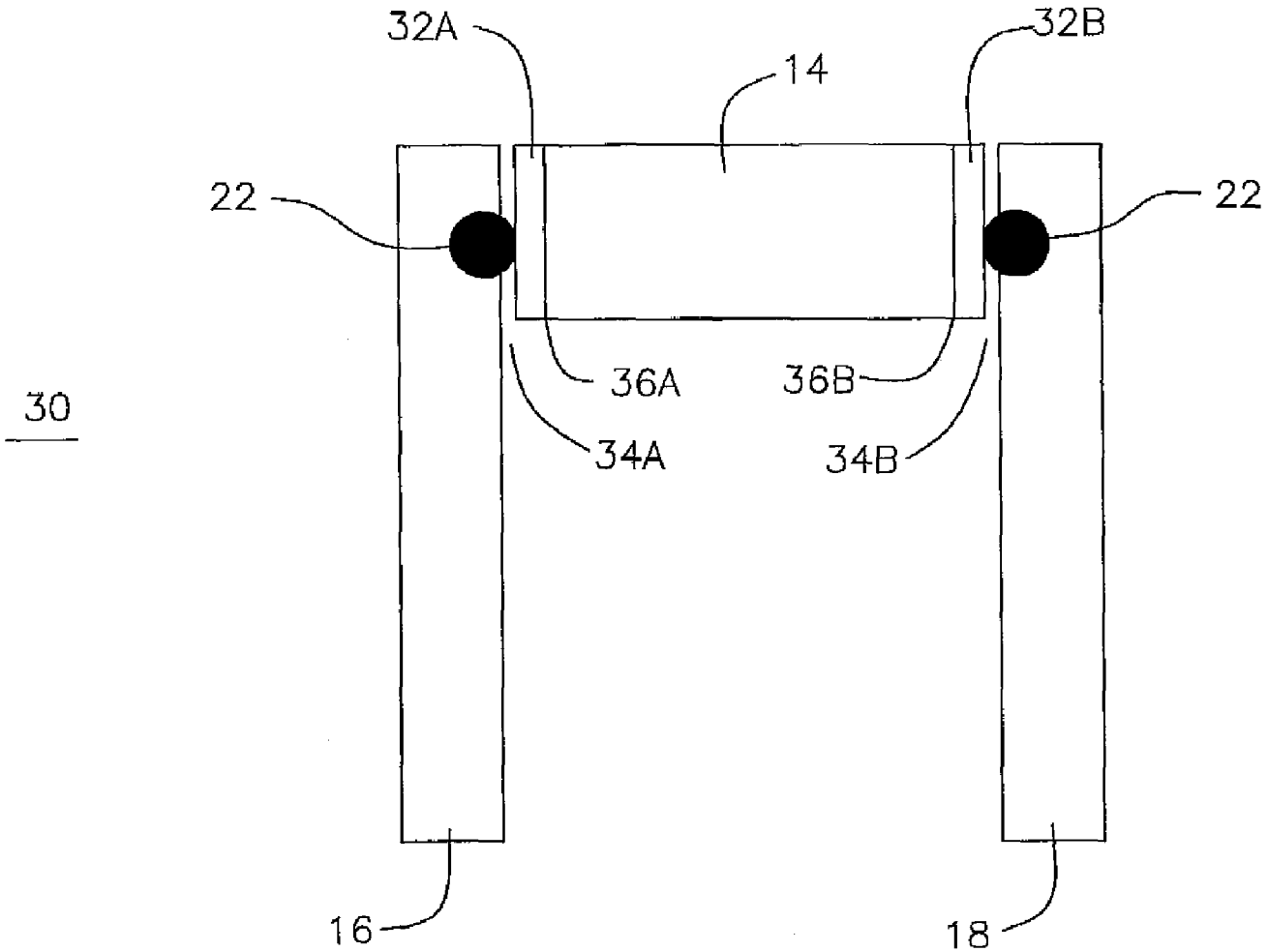
FIG. 4 shows a more detailed schematic illustrating the triple junction regions of the high-voltage insulator of FIG. 3.

FIG. 4 shows a more detailed schematic illustrating the triple junction regions of the high-voltage insulator of FIG. 3. As shown in FIG. 4, a first triple junction region 36A is formed at the joint between the insulator 14 and the conductive layer 32A. A first vacuum seal interface gap 34A is formed in the space between the conductive layer 32A and the anode electrode 16. A second triple junction region 36B is formed at the joint between the insulator 14 and the conductive layer 32B. A second vacuum seal interface gap 34B is formed in the space between the conductive layer 32B and the cathode electrode 18. Thus, the triple junction regions 36A and 36B are now separated from the vacuum seal interface gaps 34A and 34B, respectively.

Because there is no microscopic gap between the conductive layers 32A and 32B and the insulator 14, and the gaps between the conductive layers 32A and 32B and the insulator 14 are smaller than the molecular size of gases, the joints between the conductive layers and the insulator 14 also seal the vacuum from atmospheric pressure. Since the triple junction regions 34A and 34B are formed at the joint between the conductive layers 32A and 32B and the insulator 14 there is no gap at the triple junction regions any more, which greatly reduces the local electric field at the triple junction regions.

In one embodiment, the conductive layers 32A and 32B are formed by doping metal particles into the insulator 14. As an example, the metal particles can include aluminum. The metal particles are doped into the insulator 14 by using well-known doping techniques. In another embodiment, the conductive layers 32A and 32B are deposited on the insulator 14 using well-known deposition techniques. In another embodiment, the conductive layers 32A and 32B are bonded onto the insulator 14 so that there is no trapped void volume. Gluing (e.g., applying an epoxy) is only one example of an approach that can be used to bond the conductive layers 32A and 32B to the insulator 14. Those skilled in the art will recognize that other joining techniques may be used to join the conductive layers 32A and 32B to the insulator 14 at an atom level without a microscopic gap produced between the conductive layers and the insulator 14.

Each of the above-described techniques for forming the conductive layers 32A and 32B has a commonality in that the insulator 14 and the conductive layers are joined together in the atomic level to form the triple junction so that there is no microscopic gap between the insulator 14 and the conductive layers.

Because the triple junction regions in the extraction system of FIGS. 3 and 4 are separated from the vacuum seal interface gaps that are formed in the space between the conductive layer 32A and the anode electrode 16 and the space between the conductive layer 32B and the cathode electrode 18, the gases that used to be trapped at the triple junction regions now are trapped in the space 34A between the conductive layer 32A and the anode electrode 16 and the space 34B between the conductive layer 32B and the cathode electrode 18; there is no microscopic gap at the triple junctions 36A and 36B. Because the conductive layer 32A and the anode electrode 16 or the conductive layer 32B and the cathode electrode 18 have the same electrical potential, the trapped gases have no opportunity to initiate a secondary ionization and trigger a triple junction breakdown that will cause voltage or ion beam instability and subsequent failure of an ion implanter.

It is apparent that there has been provided with this disclosure a high voltage insulator that prevents instability in an ion implanter due to triple-junction breakdown. While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the invention.

What is claimed is:

1. An apparatus for preventing triple junction breakdown, comprising:

a first metal electrode;

a second metal electrode;

an insulator disposed between the first metal electrode and the second metal electrode, wherein the insulator has at least one surface between the first metal electrode and the second metal electrode that is exposed to a vacuum;

a first conductive layer located between the first metal electrode and the insulator, wherein the first conductive layer prevents triple junction breakdown from occurring at an interface of the first electrode, insulator and vacuum; and a second conductive layer located between the second metal electrode and the insulator opposite the first conductive layer, wherein the second conductive layer prevents triple junction breakdown from occurring at an interface of the second electrode, insulator and vacuum.

2. The apparatus according to claim 1, wherein the first and second conductive layers comprise metal particles doped into the insulator.

3. The apparatus according to claim 1, wherein the first and second conductive layers are deposited on the insulator.

4. The apparatus according to claim 1, wherein the first and second conductive layers are bonded onto the insulator.

5. The apparatus according to claim 4, wherein the first and second conductive layers are glued onto the insulator.

6. The apparatus according to claim 1, wherein the first and second conductive layers are joined to the insulator at an atom level without formation of a microscopic gap.

7. The apparatus according to claim 1, further comprises a first O-ring and a second O-ring, wherein the first O-ring is sandwiched between the first conductive layer and the first metal electrode and the second O-ring is sandwiched between the second conductive layer and the second metal electrode.

8. An apparatus for preventing triple junction instability in an ion implanter, comprising:

a first metal electrode;

a second metal electrode;

an insulator disposed between the first metal electrode and the second metal electrode, wherein the insulator has at least one surface between the first metal electrode and the second metal electrode that is exposed to a vacuum that transports an ion beam generated by the ion implanter;

a first conductive layer located between the first metal electrode and the insulator, wherein the first conductive layer prevents triple junction breakdown from occurring at an interface of the first electrode, insulator and vacuum; and a second conductive layer located between the second metal electrode and the insulator opposite the first conductive layer, wherein the second conductive layer prevents triple junction breakdown from occurring at an interface of the second electrode, insulator and vacuum.

9. The apparatus according to claim 8, wherein the first and second conductive layers comprise metal particles doped into the insulator.

10. The apparatus according to claim 8, wherein the first and second conductive layers are deposited on the insulator.

11. The apparatus according to claim 8, wherein the first and second conductive layers are bonded onto the insulator.

12. The apparatus according to claim 11, wherein the first and second conductive layers are glued onto the insulator.

13. The apparatus according to claim 8, wherein the first and second conductive layers are joined to the insulator at an atom level without formation of a microscopic gap.

14. The apparatus according to claim 8, further comprises a first O-ring and a second O-ring, wherein the first O-ring is sandwiched between the first conductive layer and the first metal electrode and the second O-ring is sandwiched between the second conductive layer and the second metal electrode.

15. A method for preventing triple junction instability in an ion implanter, comprising:

providing a first metal electrode;

providing a second metal electrode;

disposing an insulator between the first metal electrode and the second metal electrode, wherein the insulator has at least one surface between the first metal electrode and the second metal electrode that is exposed to a vacuum that transports an ion beam generated by the ion implanter;

providing a first conductive layer located between the first metal electrode and the insulator, wherein the first conductive layer prevents triple junction breakdown from occurring at an interface of the first electrode, insulator and vacuum; and providing a second conductive layer located between the second metal electrode and the insulator opposite the first conductive layer, wherein the second conductive layer prevents triple junction breakdown from occurring at an interface of the second electrode, insulator and vacuum.

16. The method according to claim 15, wherein the providing of the first and second conductive layers comprises doping metal particles into the insulator.

17. The method according to claim 15, wherein the providing of the first and second conductive layers comprises depositing the first and second conductive layers on the insulator.

18. The method according to claim 15, wherein the providing of the first and second conductive layers comprises bonding the first and second conductive layers onto the insulator.

19. The method according to claim 18, wherein the bonding comprises gluing the first and second conductive layers onto the insulator.

20. The method according to claim 15, wherein the providing of the first and second conductive layers comprises joining the first and second conductive layers to the insulator at an atom level without formation of a microscopic gap.

21. The method according to claim 15, further comprising providing a first O-ring and a second O-ring, wherein the first O-ring is sandwiched between the first conductive layer and the first metal electrode and the second O-ring is sandwiched between the second conductive layer and the second metal electrode.

* * * * *